United States Patent [19]

Iijima et al.

[11] 4,268,365

[45] May 19, 1981

[54] METHOD OF ELECTROLYSIS OF AN ALKALI METAL CHLORIDE

[75] Inventors: Tokuzo Iijima, Kobe; Toshiharu Yamamoto, Akashi; Kazuo Kishimoto; Takamichi Komabashiri, both of Takasago; Toshiji Kano, Kobe, all of Japan

[73] Assignee: Kanegafuchi Kagaku Kogyo Kabushiki Kaisha, Osaka, Japan

[21] Appl. No.: 955,793

[22] Filed: Oct. 30, 1978

Related U.S. Application Data

[63] Continuation-in-part of Ser. No. 944,790, Sep. 22, 1978, abandoned.

[30] Foreign Application Priority Data

Sep. 22, 1977 [JP] Japan ..... 52/114107
Dec. 26, 1977 [JP] Japan ..... 52/159732

[51] Int. Cl.[3] ..... C25B 1/34
[52] U.S. Cl. ..... 204/98; 204/128
[58] Field of Search ..... 204/98, 128

[56] References Cited

U.S. PATENT DOCUMENTS

| | | | |
|---|---|---|---|
| 2,681,884 | 6/1954 | Butler, Jr. | 204/98 |
| 3,242,059 | 3/1966 | Cottam et al. | 204/98 |
| 3,291,708 | 12/1966 | Juda | 204/128 |
| 3,809,630 | 5/1974 | De Nora et al. | 204/128 |
| 3,904,495 | 9/1975 | Eng et al. | 204/98 |
| 3,928,150 | 12/1975 | Rahn et al. | 204/98 |
| 4,025,405 | 5/1977 | Dotson et al. | 204/296 |
| 4,035,254 | 7/1977 | Gritzner | 204/128 |
| 4,086,149 | 4/1978 | Martinsons et al. | 204/59 R |
| 4,124,477 | 11/1978 | Tokawa et al. | 204/296 |
| 4,191,618 | 3/1980 | Coher et al. | 204/98 |
| 4,210,501 | 7/1980 | Dempsey et al. | 204/98 |
| 4,214,958 | 7/1980 | Coher et al. | 204/98 |

FOREIGN PATENT DOCUMENTS

| | | | |
|---|---|---|---|
| 2741956 | 3/1978 | Fed. Rep. of Germany | 204/98 |

*Primary Examiner*—R. L. Andrews
*Attorney, Agent, or Firm*—Armstrong, Nikaido, Marmelstein & Kubovcik

[57] ABSTRACT

Electrolysis of an alkali metal chloride solution using an ion exchange membrane is carried out by bringing the anode and the cathode into contact with the surfaces of the ion exchange membrane, whereby electrolysis is conducted at a lower voltage and alkali metal chloride contained in the cell liquor is markedly reduced. In the case of employing a finger type cell, alkali metal chloride in the cell liquor is surprisingly lowered by maintaining the ratio of the effective area of the cation exchange membrane to that of the anode at 1.1 or less. This invention facilitates the conversion of asbestos or modified asbestos electrolysis methods to the ion exchange membrane methods with such ease that the quality of the products is not only enhanced but the serious problems of environmental pollution due to asbestos are solved.

9 Claims, 2 Drawing Figures

METHOD OF ELECTROLYSIS OF AN ALKALI METAL CHLORIDE

This application is a continuation-in-part of the application filed Sept. 22, 1978, Ser. No. 944,790 abandoned.

BACKGROUND OF THE INVENTION

The present invention relates to a novel method of electrolysis of an alkali metal chloride solution using a cation exchange membrane. More particularly, the present invention relates to an ion exchange membrane electrolysis method carrying out electrolysis by bringing an anode, a cation exchange membrane and a cathode into contact with each other, thereby utilizing the insulating property inherent in the cation exchange membrane.

It has heretofore been known and conventional that ion exchange membrane electrolysis is effected not by bringing the anode, the cation exchange membrane and the cathode into contact with each other, but by maintaining uniform electrode-cation exchange membrane spacing. Since the spacing inevitably results in enhanced cell voltage, a series of studies have been focussed on how to minimize the electrode-cation exchange membrane spacing in an electrolysis method using ion exchange membranes.

It is an object of the present invention to provide an electrolysis method of an alkali metal chloride solution which is capable of reducing cell voltage remarkably.

Another object of the present invention is to provide an electrolysis method of an alkali metal chloride solution capable of obtaining the product in a high quality, namely, alkali metal hydroxide liquor containing alkali metal chloride in a low concentration.

Still another object of the present invention is to provide a method capable of converting asbestos or modified asbestos diaphragm cells to ion exchange membrane cells, whereby alkali metal hydroxide containing alkali metal chloride in a low concentration is produced.

A further object of the present invention is to provide an electrolysis method free from environmental pollution and danger to human bodies by remodeling asbestos or modified asbestos diaphragm cells to ion exchange membrane cells.

A still further object of the present invention is to provide a method of carrying out electrolysis with anode-cathode spacing reduced to substantially the same distance as the membrane thickness, whereby electrolysis is conducted with a low cell voltage and a high cell liquor concentration to result in reduction in the operating cost.

In order to eliminate the defect relating to the cell voltage in a conventional method of an ion exchange membrane electrolysis, it has been determined by the present inventors through a series of studies that the foregoing objects can be attained by bringing the electrodes into contact with the ion exchange membrane. Up to now, it has been thought, even by experienced workers, that adhesion of the electrodes to the ion exchange membrane would cause damage to and loss of the ion exchange membrane or lower the performance of the ion exchange membrane. The present inventors have directed their attention to the insulating property inherent in an ion exchange membrane and then attempted to utilize the insulating property wherein the electrodes are fastened to the ion exchange membrane and electrolysis is performed. Through this test, it has been determined by the present inventors that neither damage nor a decrease in performance takes place, which has never been expected.

SUMMARY OF THE INVENTION

The present invention comprises fastening the anode and the cathode to the ion exchange membrane to maintain the minimum anode-cathode spacing as well as to utilize the ion exchange membrane as an insulator, whereby the electrolysis of alkali metal chloride can be executed in the substantial absence of chlorine and/or hydrogen gases between the electrodes and the cation exchange membrane.

DETAILED DESCRIPTION

Figure 1:
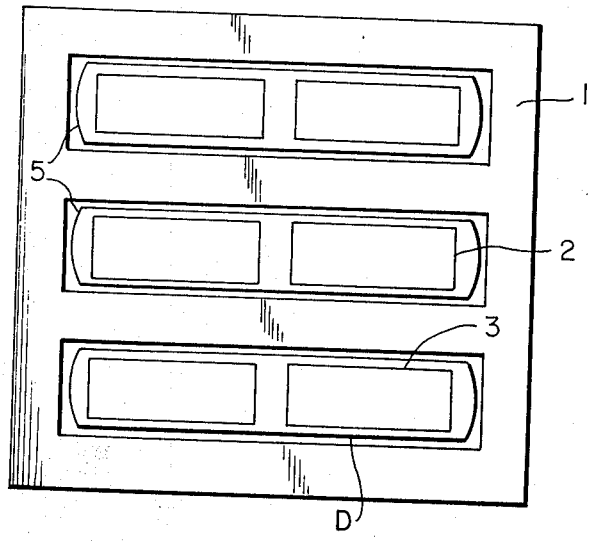
FIG. 1 is a horizontal cross-sectional view of a finger type cell in which the cation exchange membrane is installed.

In accordance with the present invention, there exists substantially no gas gap since chlorine and/or hydrogen gases hardly reside between the electrodes and the cation exchange membrane and cell voltage is markedly reduced due to the minimum anode-cathode spacing being maintained. In addition, the present invention enhances the quality of the product obtained. That is, the present invention permits substantially no residence of chlorine gas between the anode and the cation exchange membrane, so that the alkali metal chloride concentration in the alkali metal hydroxide produced can be effectively decreased. The present invention thus provides an electrolysis method wherein electrolysis is carried out at a low cell voltage with a reduced concentration of alkali metal chloride contained in alkali metal hydroxide.

In a conventional method of ion exchange membrane electrolysis, electrodes are not brought into contact with the cation exchange membrane but are spaced apart from the membrane by a uniform distance, so that chlorine gas and/or hydrogen gas are unavoidably retained between the electrodes and the cation exchange membrane. Accordingly, it is inevitable that the decrease in cell voltage measured is much larger than that calculated theoretically from the electroconductivities of the alkali metal chloride aqueous solution and the alkali metal hydroxide liquor. Cell voltage in the present invention is decreased in the range of from about 0.1 to about 0.6 volts at an anode current density of 25 $A/dm^2$, as compared with a conventional method of ion exchange membrane electrolysis. Moreover, the alkali metal chloride concentration contained in an alkali metal hydroxide solution can be decreased as compared with a conventional method of ion exchange membrane electrolysis since no gases reside between the anode and the cation exchange membrane. This advantageously results in a reduction in the concentration of alkali metal chloride in the product obtained by concentrating the alkali metal hydroxide liquor to about 45 to 50%. In cases where a sodium chloride aqueous solution is electrolysed under normal conditions according to the present invention, the NaCl concentration contained in the sodium hydroxide liquor concentrated to 50% decreases in the range of from about 5 to about 50 ppm at an anode current density of 25 A/dm$^2$, as compared with a conventional method of ion exchange membrane electrolysis.

A typical cation exchange membrane is usually about 0.01 to about 2 mm in thickness. Hence, when the anode, the cation exchange membrane and the cathode are brought into contact with each other, the anode-cathode distance is about 0.1 to about 2 mm, if only the electrodes are elaborately finished up to be as perfectly flat as possible and the anode, the cation exchange membrane and the cathode are completely brought into contact with each other. Allowance of flatness of the electrodes is commonly in the range of ±1 mm, although dependent upon the size of the electrodes, and thus the average anode-cathode distance may on occasion be more than 2 mm even though the anode, the cation exchange membrane and the cathode are in contact with each other. The present invention also includes the case where the anode, the cation exchange membrane and the cathode are attached only in the partial surfaces of the membrane with an average anode-cathode distance of more than 2 mm. The case is also included in the present invention where spacers of an extreme thinness are employed and the anode, the cation exchange membrane and the cathode are in contact, except where the spacers are interposed, because the spacing between the anode and the cathode is shortened utilizing the insulating property of the cation exchange membrane.

To place the anode and the cathode closely adjacent to the both sides of the cation exchange membrane, various and different methods are used. One method is to position the cation exchange membrane onto the surface of the anode and then to push against the cathode onto the other surface of the cation exchange membrane mechanically, for example, by the use of a spring. Another method is to locate the cation exchange membrane onto the surface of the cathode and then to attach the anode to the other side of the cation exchange membrane, for example, by means of a spring. A further method is to interpose the cation exchange membrane between the anode and the cathode, and then to push against the anode and/or cathode mechanically, for example, by the use of a spring.

The present invention is applicable to a filter press type cell or a finger type cell. When the present invention is applied to a finger type cell, the cation exchange membrane is installed in a finger type cell and electrolysis is conducted.

As finger type electrolytic cells useful in the present invention there are included not only a finger type construction cell such as that described at page 93, *Chlorine—Its Manufacture, Properties and Uses,* edited by J. S. Sconce, issued Reinhold Publishing Corporation, New York, 1962, incorporated herein by reference, but also a flattened tube type construction. Nowadays, a flattened tube type construction cell is also generally referred to as a finger type electrolytic cell.

The present invention is available to a monopolar finger type cell or a bipolar finger type cell. As an electrolytic cell to which the present invention may be applied, there are diaphragm electrolytic cells which are reconstructed by installing at least one depleted brine removing outlet and at least one water addition line in, for example, an H-4 type and H-2A type of cell manufactured by Hooker Chemicals & Plastics Corporation; and a DS-45 type and DS-85 type of cell manufactured by Diamond Shamrock Corporation, as a monopolar electrolytic cell; and a "GLANOR" V-11-44 type of cell manufactured by P.P.G. Industries Inc., as a bipolar electrolytic cell. When the cells are newly manufactured, it is preferred to design the cell so as to be able to install the ion exchange membrane feasibly therein.

In electrolysis using a finger type cell, it is desirable to employ an expandable dimensionally stable anode by which attachment of the electrodes to the cation exchange membrane is effectively effected. The expandable dimensionally stable anode can push against the cation exchange membrane to contact the cathode with a suitable pressure by the adjustment of the strength of a spring such that no damage or loss occurs. An expandable dimensionally stable electrode comprises an electrode riser, two opposed electrode working faces and movable, electrically conductive means connecting said faces to opposite sides of said riser. For example, FIG. 8 type electrode in the U.S. Pat. No. 3,674,676 can be used conveniently. An expandable dimensionally stable electrode is used to reduce the anode-cathode gap, which is installed in a cell in a contracted state, and then remove clamping bars for expansion. The anode working face comprises an electrically conductive, electrolyte-resistant material, especially a value metal such as titanium, tantalum or alloys thereof; bearing on its surface an electrically conductive, electro-catalytically active coating which may consists of a precious metal, a precious metal oxide or other suitable materials.

The present inventors have discovered that in electrolysis using a finger type cell in which the cation exchange membrane is positioned, the quality of the product obtained can be dramatically improved if the ratio of the total effective area of the cation exchange membrane to that of the anode is about 1.1 or less, and preferably 1.05 or less. When electrolysis is conducted using a filter press type cell which has been widely employed, the ratio of the effective area of the cation exchange membrane to that of the anode is approximately 1.0.

When electrolysis is carried out in a cation exchange membrane-installed finger type cell, the NaCl concentration in the sodium hydroxide obtained is higher than in the case where the filter press type cell is employed, even though the same anode current density is used. Through an extensive study to overcome the problem, it has been found out that the NaCl concentration can be markedly lowered if the total effective area of the cation exchange membrane to that of the anode is about 1.1 or below by covering part of the cathode with the installation frame of the cation exchange membrane which is made of, for example, titanium. In cases where the ratio is 1.05 or less and under the same electrolysis conditions, no difference in the NaCl content in sodium hydroxide can be observed as compared with the filter press type cell employed.

Sodium hydroxide has been commercially produced using asbestos or modified asbestos diaphragms cells. However, sodium hydroxide prepared by the asbestos diaphragm method is poor in quality and about 0.9 to 1.2% by weight of sodium chloride is usually contained in a 50% sodium hydroxide liquor. Sodium chloride contained in asbestos diaphragm sodium hydroxide may be removed by an ammonia extraction method, hydrated sodium hydroxide method and the like, but when each of these methods is put into practice on an industrial scale, sodium hydroxide liquor is purified, at best, only to an extent ranging from about 500 to 1000 ppm, and still worse, a relatively large expenditure is required for purification. Sodium hydroxide used for the rayon industry can contain only 200 ppm or less of sodium chloride in a 50% sodium hydroxide. Accordingly, it is rather difficult to produce sodium hydroxide used for the rayon industry at a reasonable and moderate cost by the purification of asbestos diaphragm sodium hydroxide.

When the asbestos or modified asbestos diaphragm cells are converted to the ion exchange membrane cells according to the present invention, not only is the quality of the product improved, but also the operation of a plant becomes feasible. That is, due to the fact that there is no falling out of salts in the evaporation system, washing of the slurry lines and the vessels and the like is not required, and the operation may be carried out almost automatically. Another advantage obtained by converting the asbestos or modified asbestos diaphragm method to the ion exchange membrane method is that a cell liquor hardly containing NaCl is obtained.

Sodium hydroxide consumed in factories or within the Kombinat may be supplied directly without being concentrated by evaporation to 45 to 50%. In contrast, cell liquor produced by asbestos or modified asbestos diaphragm methods contains a large amount of sodium chloride, and must be concentrated to 45 to 50%, even though it is for personal consumption in factories or is consumed within the Kombinat, and it is used satisfactorily with a low concentration of sodium hydroxide. By converting to the ion exchange membrane method, sodium hydroxide containing substantially no sodium chloride is obtained and, thus, may be supplied for use immediately by being cooled to a desired temperature, or may be mixed with a 50% concentrated sodium hydroxide to a desired concentration and then supplied for use.

More advantageous according to the present invention is the ability to solve the environmental contamination and the danger to human bodies resulting from asbestos by remodeling the asbestos or modified asbestos diaphragm method to the ion exchange membrane method.

Figure 2:
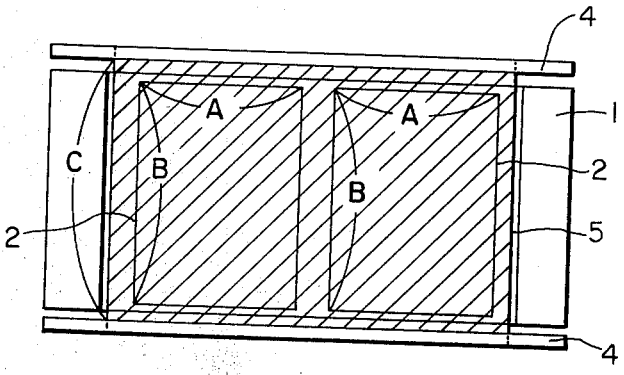
FIG. 2 is a vertical cross-sectional view of a finger type cell in which the cation exchange membrane is positioned.

When the present invention is applied to a finger type cell, the ratio of the total effective area of the cation exchange membrane to that of the anode is approximately 1.1 or less, more preferably 1.05 or less. These ratios are practical rather than theoretical. The effective area of the anode means the sum total of the area of the anode which is attached to the ion exchange membrane, where electrolysis is substantially effected. In FIGS. 1 and 2, the sum total of the effective anode surfaces equals 12·AB.

Referring to the drawings, FIG. 1 is a horizontal cross-sectional view of a finger type cell in which the cation exchange membrane is installed. (1) is the cathode and (2) is the anode. The sum total of the effective area of the anode is the sum total of the portion depicted in the thick line, numbered (3). The cation exchange membrane is identified by the numeral (5).

The sum total of the effective area of the cation exchange membrane is the sum total of the portion of the cation exchange membrane, the surface of which is not covered nor disturbed by the cation exchange membrane installation frame, the press plate and any materials other than the membrane.

FIG. 2 is a vertical cross-sectional view of a finger type cell in which the cation exchange membrane is positioned. (1) is the cathode, (2) is the anode, (4) is the cation exchange membrane installation frame and (5) is the cation exchange membrane. The sum total of the effective area of the cation exchange membrane is represented by the sum total of the shaded portion; it is equal to 3·CD (D; circumferential length depicted in the thick line) in FIGS. 1 and 2.

In a finger type cell the area of the cathode is generally larger than that of the anode, since asbestos are deposited under a reduced pressure onto the cathode. In interposing the cation exchange membrane between the anode and the cathode, when the cation exchange membrane is positioned along the surface of the cathode, the effective area of the cation exchange membrane becomes 1.15 times or more of that of the anode. If electrolysis is performed using the aforesaid cell, the sodium chloride concentration in sodium hydroxide prepared is too high (approximately more than 400 ppm when recalculated to the content in a 50% sodium hydroxide) to be utilized in the rayon industry and the like. The present inventors have succeeded in reducing the sodium chloride content in sodium hydroxide by carrying out ion exchange membrane electrolysis at the ratio of effective area of the cation exchange membrane to that of the anode of 1.1 or below, more desirably 1.05 or below, by partially covering the surface of the cathode with the cation exchange membrane installation frame.

The cation exchange membrane installation frame is made of titanium, FRP, heat-resistant polyvinyl chloride, polypropylene, perfluorocarbon polymer and any other heat-resistant and corrosion-resistant materials. Metals lined with perfluorocarbon polymer, rubber and the like may be used. Perfluorocarbon polymer includes polyfluorovinylidene, polytetrafluoroethylene, polydichlorofluoroethylene, polyhexafluoropropylene, copolymers thereof and the like.

The cation exchange membrane is fastened by pressure or joined to the cation exchange membrane installation frame. To the cation exchange membrane installation frame made of perfluorocarbon polymer, or perfluorocarbon polymer or rubber lined metals, the cation exchange membrane is positioned by joining. Joining includes welding by polyfluorovinylidene fusing, and the like. Fastening by pressure includes the case, for example, where a packing made of teflon and any other corrosion-resistant materials is interposed between the cation exchange membrane installation frame and the cation exchange membrane, then fastened by the use of titanium bolts and nuts. It is preferred to completely attach the cation exchange membrane to the installation frame thereof by the combined use of joining and fastening by pressure.

Alkali metals used in the present invention include sodium, potassium and the like.

The present invention will be illustrated hereinbelow in more detail by way of examples, which examples are not to be construed in any manner to be limiting of the invention.

EXAMPLE 1

A monopolar finger type cell comprising an expandable dimensionally stable anode, an iron mesh cathode and an FRP cover was employed. As the cation exchange membrane, "NaFion #315" manufactured by E. I. Du Pont de Nemours & Company was formed cylindrically and then positioned by bolting to the cation exchange membrane installation frame. The expandable dimensionally stable anode was expanded to bring the anode, the cation exchange membrane and the cathode into contact with each other.

To the anode compartment was supplied continuously the hydrochloric acid-containing sodium chloride solution and deionized water was continuously fed to the cathode compartment, thus 2,000 A electric current being passed through the cell. The anode current density was 23.5 A/dm$^2$. Electrolysis was continued for 116 days. The results obtained are given in Table 1.

The following results after 7 days operation were obtained.

| | |
|---|---|
| NaOH concentration in the catholyte | 16.9% |
| NaCl concentration in the catholyte | 16 ppm |
| NaCl concentration when recalculated to a 50% NaOH liquor | 47 ppm |
| Current efficiency | 86% |
| Cell voltage | 3.24 V |

TABLE 1

| | Feed Brine | | | Depleted Brine | | Cell Liquor | | | Electric Current | Cell |
|---|---|---|---|---|---|---|---|---|---|---|
| D.O.L. (Days) | Temp. (°C.) | NaCl Conc. (N) | HCl Conc. (N) | Temp. (°C.) | NaCl Conc. (N) | Temp. (°C.) | NaOH Conc. (%) | NaCl Conc. (ppm) | Efficiency (%) | Voltage (V) |
| 1 | 40 | 3.1 | 0.20 | 74 | 2.1 | 75 | 16.4 | 24 | 87 | 3.26 |
| 5 | 41 | 3.0 | 0.19 | 74 | 2.0 | 75 | 16.5 | 21 | 85 | 3.22 |
| 10 | 39 | 2.9 | 0.21 | 77 | 1.9 | 77 | 16.7 | 19 | 86 | 3.20 |
| 20 | 41 | 3.0 | 0.20 | 78 | 2.0 | 79 | 16.5 | 23 | 87 | 3.20 |
| 30 | 40 | 3.0 | 0.21 | 78 | 2.1 | 79 | 16.4 | 20 | 86 | 3.21 |
| 40 | 41 | 3.1 | 0.20 | 76 | 2.1 | 77 | 16.8 | 22 | 86 | 3.23 |
| 50 | 39 | 3.0 | 0.19 | 77 | 2.0 | 78 | 16.6 | 19 | 87 | 3.25 |
| 60 | 40 | 3.0 | 0.19 | 78 | 2.0 | 79 | 16.4 | 24 | 87 | 3.21 |
| 70 | 41 | 3.1 | 0.19 | 77 | 2.1 | 77 | 16.7 | 21 | 85 | 3.20 |
| 80 | 39 | 3.0 | 0.20 | 75 | 2.0 | 76 | 16.7 | 19 | 85 | 3.23 |
| 90 | 40 | 3.0 | 0.21 | 77 | 2.0 | 78 | 16.4 | 20 | 86 | 3.21 |
| 100 | 40 | 3.1 | 0.20 | 79 | 2.1 | 79 | 16.5 | 23 | 85 | 3.23 |
| 110 | 40 | 3.1 | 0.20 | 76 | 2.1 | 77 | 16.6 | 19 | 86 | 3.25 |
| 116 | 39 | 3.0 | 0.19 | 75 | 2.1 | 75 | 16.8 | 22 | 86 | 3.25 |

EXAMPLE 2

Electrolysis was carried out under similar conditions to Example 1 except that 3,000 A electric current was passed through the cell and the anode current density was 35.3 A/dm$^2$. Operation was continued for 28 days, the results of which are tabulated in Table 2.

EXAMPLE 3

Onto a finger type cell comprising an expandable dimensionally stable anode and an iron cathode, a "Nafion #315" membrane manufactured by E. I. Du Pont de Nemours & Company was installed using the cation exchange membrane installation frame. The installation frame was made of polyfluorovinylidene lined iron. The installation frame and the "Nafion #315" membrane were welded together by polyfluorovinylidene. The expandable dimensionally stable anode was expanded to connect and fasten the anode, the cation exchange membrane and the cathode to each other. The ratio of the effective area of the "Nafion #315" membrane to that of the anode was 1.0. The hydrochloric acid containing sodium chloride solution was continuously fed into the anode compartment and deionized water was continuously supplied into the cathode compartment. Then 2,000 A electric current was passed through the cell. The anode current density was 23.5 A/dm$^2$. The brine supplied was 3 N with respect to the NaCl concentration and the HCl concentration in the brine was 0.2N.

EXAMPLE 4

In this example the cation exchange membrane installation frame was made of titanium. By way of the installation frame the cation exchange membrane was secured with bolts and nuts and the teflon packing to the cell. The ratio of the effective area of the cation exchange membrane to that of the anode was 1.09. 2,000 A electric current was passed. Under the conditions of Example 3, electrolysis was thus continued for 7 days and the results obtained were shown as below.

| | |
|---|---|
| NaOH concentration in the catholyte | 16.0% |
| NaCl concentration in the catholyte | 23 ppm |
| NaCl concentration when recalculated to a 50% NaOH liquor | 72 ppm |
| Current efficiency | 84% |
| Cell voltage | 3.22 V |

TABLE 2

| | Feed Brine | | | Depleted Brine | | Cell Liquor | | | Electric Current | Cell |
|---|---|---|---|---|---|---|---|---|---|---|
| D.O.L. (Days) | Temp. (°C.) | NaCl Conc. (N) | HCl Conc. (N) | Temp. (°C.) | NaCl Conc. (N) | Temp. (°C.) | NaOH Conc. (%) | NaCl Conc. (ppm) | Efficiency (%) | Voltage (V) |
| 1 | 35 | 3.0 | 0.21 | 81 | 2.1 | 82 | 16.4 | 18 | 85 | 3.72 |
| 5 | 34 | 3.1 | 0.20 | 80 | 2.1 | 81 | 16.4 | 16 | 87 | 3.72 |
| 10 | 33 | 3.1 | 0.20 | 81 | 2.1 | 81 | 16.3 | 17 | 86 | 3.70 |
| 15 | 33 | 3.0 | 0.19 | 81 | 2.0 | 82 | 16.0 | 17 | 87 | 3.70 |
| 20 | 34 | 2.9 | 0.19 | 80 | 1.9 | 81 | 16.1 | 18 | 87 | 3.70 |
| 25 | 33 | 3.0 | 0.20 | 81 | 2.0 | 82 | 16.0 | 18 | 86 | 3.71 |
| 28 | 34 | 3.0 | 0.21 | 80 | 1.9 | 81 | 16.1 | 16 | 87 | 3.74 |

COMPARATIVE EXAMPLE 1

"Nafion #315" membrane was attached by "joining" to the surface of the cathode. The ratio of the effective area of the membrane to that of the anode was 1.16. Between the cathode and the membrane rod spacers (2 mm in diameter) were interposed. The operation was then effected for 7 days under the same conditions as Example 1 excepting the foregoing. The obtained results are given below.

| | |
|---|---|
| NaOH concentration in the catholyte | 16.3% |
| NaCl concentration in the catholyte | 168 ppm |
| NaCl concentration when recalculated to a 50% NaOH liquor | 515 ppm |
| Current efficiency | 80% |
| Cell voltage | 3.56 V |

COMPARATIVE EXAMPLE 2

The same experiment as in Comparative Example 1 was carried out excepting that the ratio of the effective area of the cation exchange membrane to that of the anode was 1.12. The following results were obtained after 7 days operation.

| | |
|---|---|
| NaOH concentration in the catholyte | 16.1% |
| NaCl concentration in the catholyte | 149 ppm |
| NaCl concentration when recalculated to a 50% NaOH liquor | 463 ppm |
| Current efficiency | 81% |
| Cell voltage | 3.57 V |

What is claimed is:

1. In a method of electrolysis of alkali metal chloride using a cation exchange membrane, the improvement which comprises positioning the cation exchange membrane intermediate the anode and cathode in such a way that the respective surfaces of both the anode and the cathode are in intimate contact with the cation exchange membrane.

2. The method of claim 1, wherein the anode is an expandable dimensionally stable anode.

3. The method of claim 1, wherein the electrolytic cell is a finger type electrolytic cell.

4. The method of claim 3, wherein the ratio of the effective area of the cation exchange membrane to that of the anode is 1.1 or less.

5. The method of claim 4, wherein the ratio of the effective area of the cation exchange membrane to that of the anode is 1.05 or less.

6. The method of claim 1, wherein the cation exchange membrane is secured by pressure to a cation exchange membrane installation frame which is made of titanium, FRP, heat-resistant polyvinyl chloride, polypropylene, fluorocarbon polymer, or fluorocarbon polymer or rubber lined metals.

7. The method of claim 1, wherein the cation exchange membrane is joined to a cation exchange membrane installation frame which is made of fluorocarbon polymer, or fluorocarbon polymer or rubber lined metals.

8. The method of claim 1, wherein the cation exchange membrane is secured by pressure and joining to a cation exchange membrane installation frame which is made of fluorocarbon polymer, or fluorocarbon or rubber lined metals.

9. The method of claim 1, wherein the electrolytic cell is a diaphragm cell which is equipped with at least one depleted brine removing outlet in the anode compartment and at least one water adding line in the cathode compartment.

* * * * *

Notice of Adverse Decision in Interference

In Interference No. 100,783, involving Patent No. 4,268,365, T. Iijima, T. Yamamoto, K. Kishimoto, T. Komabashiri and T. Kano, METHOD OF ELECTROLYSIS OF AN ALKALI METAL CHLORIDE, final judgment adverse to patentees was rendered Dec. 10, 1984, as to claims 1 and 9.

[*Official Gazette April 30, 1985.*]